US005252376A

United States Patent [19]

Greenberg et al.

[11] Patent Number: 5,252,376

[45] Date of Patent: Oct. 12, 1993

[54] END CAP AND CORNER ASSEMBLY FOR FLUSH FITTING PROTECTIVE STRIP ASSEMBLY AND MEANS FOR SECURING STRIP

[75] Inventors: David A. Greenberg, Winchester; Joseph W. Manning, Peabody, both of Mass.; Charles M. Wheeler, Salem; Nancy W. Splaine, Derry, both of N.H.; Thomas A. Kell, Needham, Mass.; Cherilyn M. Santore, Marblehead, Mass.; George A. Ash, Revere, Mass.

[73] Assignee: Boston Metal Products Corp., Medford, Mass.

[21] Appl. No.: 968,254

[22] Filed: Oct. 29, 1992

Related U.S. Application Data

[63] Continuation of Ser. No. 657,049, Feb. 15, 1991, abandoned.

[51] Int. Cl.[5] ..... E04F 19/02; B60J 11/00

[52] U.S. Cl. ..... 428/99; 428/31; 428/57; 293/128; 52/716.6; 52/718.04

[58] Field of Search ..... 428/31, 57, 99; 293/128; 52/717.1, 718.1

[56] References Cited

U.S. PATENT DOCUMENTS

| | | | |
|---|---|---|---|
| 1,250,594 | 12/1917 | Knapp . | |
| 2,263,204 | 11/1941 | Clark . | |
| 2,635,935 | 4/1953 | Andersen . | |
| 3,645,569 | 2/1972 | Reilly | 403/205 |
| 3,836,043 | 9/1974 | Levin | 206/504 |
| 4,083,592 | 4/1978 | Rubin et al. | 293/62 |
| 4,303,289 | 12/1981 | Hardy | 403/205 |
| 4,948,637 | 8/1990 | Kessler | 428/99 |
| 5,013,596 | 5/1991 | Kessler | 428/100 |

*Primary Examiner*—Alexander S. Thomas
*Attorney, Agent, or Firm*—Hale and Dorr

[57] ABSTRACT

An end piece for use with a flush fitting strip bumper. The assembly protects, for example, a table or other substrate on which it is mounted. The end piece includes a shell having stepped sections arranged to engage a resilient strip and a mounting member, and a rigid clip having two spaced apart vertical portions one of which terminates in a projection including a series of teeth arranged to extend into the resilient strip.

10 Claims, 3 Drawing Sheets

END CAP AND CORNER ASSEMBLY FOR FLUSH FITTING PROTECTIVE STRIP ASSEMBLY AND MEANS FOR SECURING STRIP

This is a continuation of copending application Ser. No. 071/657,049 filed on Feb. 15, 1991, abandoned.

BACKGROUND OF THE INVENTION

This invention relates generally to protective bumper strip assemblies for protecting furniture edges, wall and display case surfaces and the like and more particularly, to an end piece or terminator assembly for the protective strips. Protective strip assemblies using resilient strip materials in various types of channels are known in the art, as illustrated in U.S. Pat. Nos. 4,083,592 and 4,808,451 and co-assigned allow patent application U.S. Pat. No. 383,905, filed on Jul. 21, 1989 now U.S. Pat No. 5,013,596 entitled "Improved Resilient Strip and Mounting Member for Flush Fitting Protective Strip Assembly" and co-assigned U.S. Pat. No. 383,763, filed on Jul. 21, 1989 now U.S. Pat. No. 5,033,244 entitled "Corner Assembly for Flush Fitting Protective Strip Assembly" and the patents cited therein, all of which are incorporated herein by reference. The protective strip assembly disclosed in the patents includes a rigid channel mounting member partially surrounded by a strip of a resilient material, such as rubber, or vinyl. The channel mounting member, which may be roughly rectangular in its outside cross-section, attaches to a surface to be protected.

The invention is used with flush fitting protective strip assemblies of the prior art, as shown in FIGS. 1 and 2, which features a mounting member 10 and an elongated strip 12 of resilient material. Strip 12, a rectangular body (which may also be semi-cylindrical), is secured in and partially surrounds the mounting member 10. As shown in FIG. 1, when installed, the protective strip fits flush against the edge of the surface to be protected 14. The mounting member 10 is not visible once the assembly is installed. Part of the resilient strip 12 has been removed from FIG. 1, in order to better show the mounting member 10. One embodiment of resilient strip also includes a pair of radially-inwardly extending latch members 16, each extending longitudinally of the strip 12. An embodiment of the mounting member 10 includes a web portion 18 having a pair of oppositely disposed web-latch extensions 20 and two leg members 22 extending from the web portion 18 away from the semi-cylindrical body. A pair of oppositely disposed base members 24, each extend from a leg member 22, away from each other and each terminate in a base latch portion 26. As shown, both the base latch portions 26 and the radial latch members 16 terminate in hooks. This feature is fully described in U.S. S.N. 383,905, identified above. Each of the pair of web latch extensions and each of the pair of base latch portions mates with the semi-cylindrical body adjacent the radial latch member. The resilient strip 12 is thus positively engaged with the mounting member 10. The invention is also suitable for use with a channel where the base latch extensions 26 have no terminal hook, also described fully U.S. S.N. 383,905 as well as with a resilient strip having a hollow radially projecting latch extension, described in U.S. Pat. No. 4,808,451, identified above.

The present invention relates to end piece or terminator assemblies and corner assemblies for flush fitting protective strips. Prior art end pieces or strip terminators have consisted largely of separate elements that are partially secured by the mounting member and butt up against the end of the vinyl strip 12, attempting to provide a flush fit. It is also known to provide support separate from the mounting member, and to butt up against this component also. These prior art terminators suffer from a shortcoming due to the fact that the vinyl shrinks after having been stretched during installation, and also generally over time even without initial stretching. When the vinyl shrinks, a gap grows between the vinyl and the end piece. The gap is unsightly and provides a point at which the strip can be caught or snagged. The strips can be accidentally pulled out of their mounting due to the protrusion of this catch point Depending on the orientation of the gap and the use of the bumper, it can also become a collection spot from food waste, dirt and other unwanted detritus. Therefore, the presence of the gap, to some extent, defeats the purpose of the bumper assembly As will be understood the shrinking vinyl also poses a problem in connection with corner assemblies, which are a special case of end assemblies. A known device of the prior art uses a corner piece and an adaptor. This type of corner is described fully in the above referenced U.S. S.N. 383,763. It features a two-piece assembly, of a corner piece and an adaptor piece. Each piece has a virtually identical mounting portion, provided with a set of co-linear latch members for engaging a resilient strip of the type shown in FIG. 1 at 12. The corner piece and the adaptor are each shaped so that they positively engage each other upon assembly. The corner piece has a slotted head portion adjoining the mounting portion. The adaptor has a head portion with a curved tongue, of a size and shape to fit within the slot of the head on the corner section. The tongue pivots into the receptacle, with the terminal portion of the tongue following a roughly circular path. The terminal portions of the tongue and the deepest most recess of the receptacle are congruently shaped to provide a positive engagement achieved upon the resilient locking of the fully inserted tongue into the head. The mounting member portions of each the corner and the adaptor are provided with holes for attaching each to the surface to be protected with screws, tacks or other suitable means.

The head portion has a flat face, which butts up against the end of the resilient strip. In order to avoid the shrinkage problem, an adhesive has sometimes been used to secure the vinyl strip to the corner and adaptor pieces. Because it is very difficult to adhere vinyl to metal, it is necessary to make the corner and adaptor pieces out of vinyl also. Although this solves the shrinkage problem to some extent, it suffers from the drawback of the need for using an adhesive. Use of adhesive adds a complicating factor, due to questions of safety during installation, securing the components in place during adhesive setting and long term durability. It is also necessary to make a pair of different and rather complicated vinyl pieces.

It is also known in the prior art to form a corner by using the resilient strip alone, without using any special corner piece. This method is rather crude and results in a sloppy appearance. It is often necessary to cut notches into the strip so that it lies flat and does not bulge out. It is difficult to neatly secure such strips to the corner without allowing them to droop.

Thus, the several objects of the invention include: to provide an end piece or terminator assembly for a flush fitting strip assembly that secures the resilient strip in place to resist shrinkage; that avoids the use of adhesives; that is relatively inexpensive to manufacture; that facilitates an aesthetic design; that hides rough cuts on vinyl ends; that will resist the formation of gaps between the strip and the end piece, and that can also be modified for use as a component in a corner assembly for a flush fitting protective strip assembly that enjoys the foregoing advantages.

SUMMARY OF THE INVENTION

The invention is an end piece for use with a flush fitting protective strip assembly for protecting a substrate, the assembly having a mounting member and a resilient strip, the end piece having a shell with a clamping wall, two side walls opposite each other and adjoining the clamping wall and an open face adjoining the clamping and side walls, the walls defining a first cavity portion and a second cavity portion. The second cavity portion defines a volume that is smaller than the first cavity portion. A rigid clip is attached to the clamping wall and extends from the first cavity portion of the shell to the second cavity portion of the shell terminating at said first cavity portion in a means for engaging the resilient strip, such as teeth. The cross-section of the first cavity portion is sized to receive the resilient strip and the cross-section of the second cavity portion is sized to receive the mounting member alone. The rigid clip is between the shell and the resilient strip and mounting member. In use, the shell is secured to the mounting member and the substrate that the resilient strip is protecting by means of a screw that passes through the shell, the rigid clip and the mounting member and which anchors in the substrate. The rigid clip and the first cavity are sized such that when the shell is tightened to the mounting member and substrate, the first toothed portion of the rigid clip is forced into the resilient strip, thereby clamping it between the shell and the mounting member, securing it against shrinkage. The invention can also be used in connection with a corner assembly, with the shell having two perpendicular extensions, each of the two extensions substantially as described above. The invention may be used with resilient strips of any cross-section, including generally rectangular, or semicylindrical with only slight modification.

DETAILED DESCRIPTION OF PREFERRED EMBODIMENTS OF THE INVENTION

Figure 1:
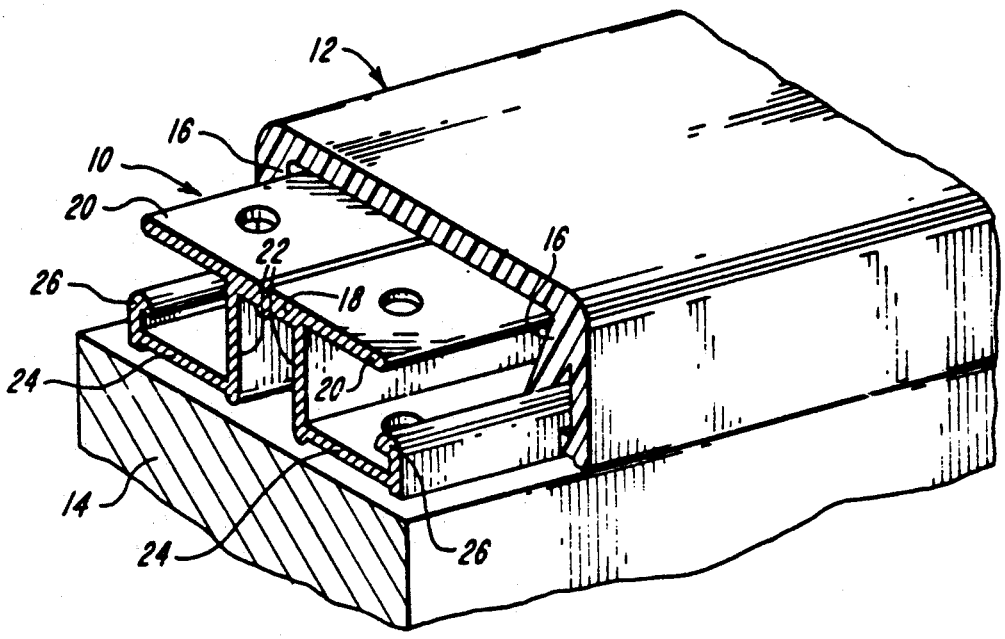
FIG. 1 (PRIOR ART)
FIG. 1 is a perspective view of a portion of a combined resilient strip and mounting member assembly of the prior art, as installed to be used with the end piece assembly of the invention.
Figure 2:
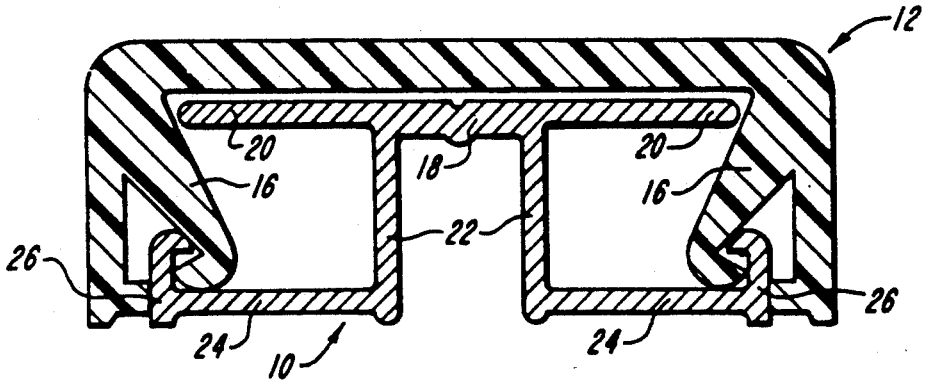
FIG. 2 is an end elevation view of the prior art resilient strip and mounting member shown in FIG. 1.
Figure 3:
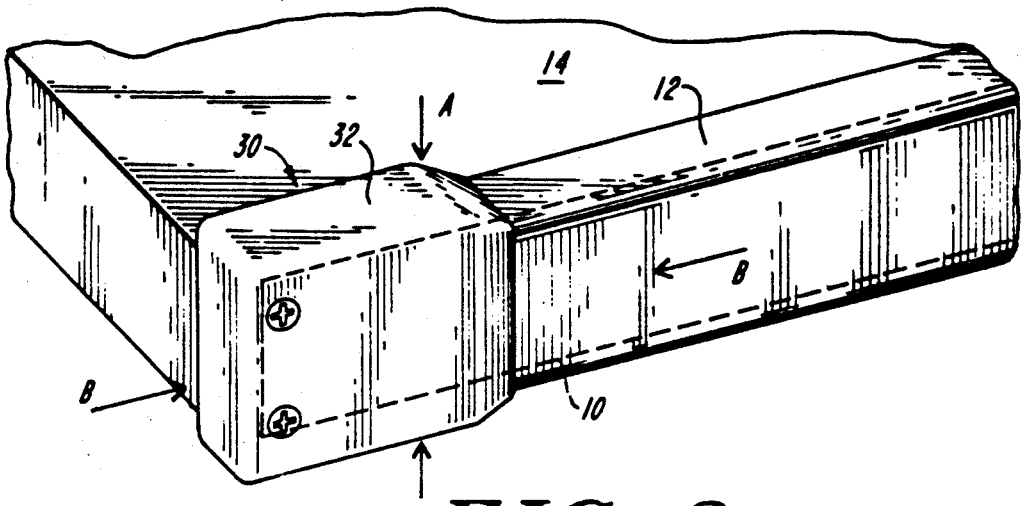
FIG. 3 is a perspective view of a combined resilient strip and mounting member in conjunction with an end piece assembly.

Referring now to FIG. 3, an assembly of a resilient strip 12, mounting member 10 (shown in phantom in outline) and end piece 30 is mounted to a table 14 in a manner consistent with use of the claimed invention. It will be understood that the resilient strip protects the edge of the table 14 which is obscured from view by the strip.

Figure 4:
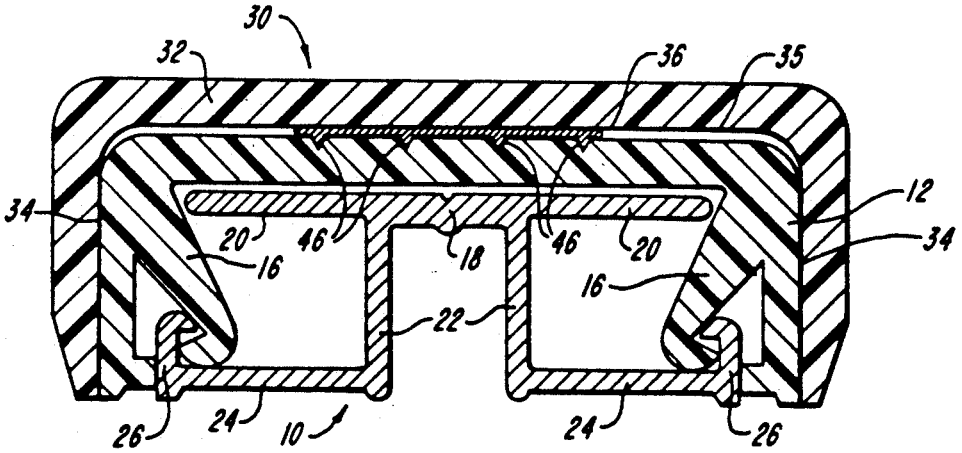
FIG. 4 is a cross-sectional view of the end piece and resilient strip assembly of FIG. 3, along the lines A—A.
Figure 5:
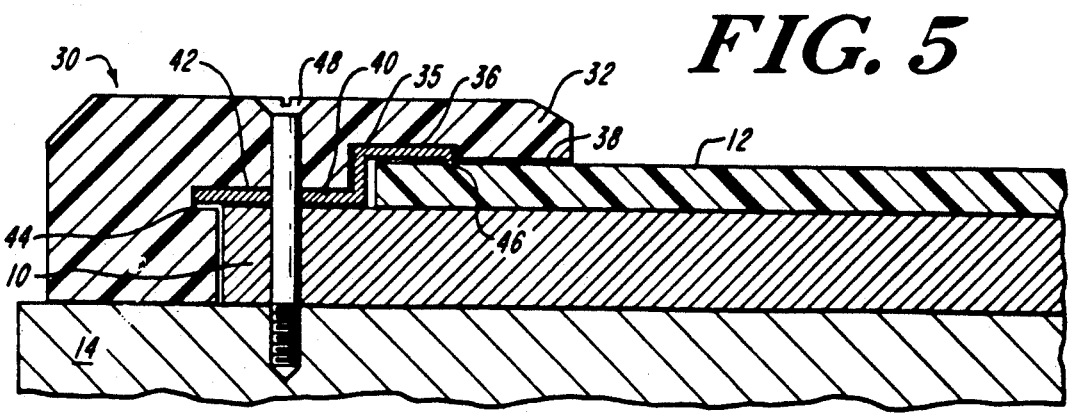
FIG. 5 is a cross-sectional view of the end piece and resilient strip and mounting member of FIG. 3, along the lines B—B.

Referring now to FIGS. 4 and 5, the means by which the end piece or end cap 30 engages the mounting member 10 and resilient strip 12 will be understood. As can be seen in FIG. 5, the mounting member 10 extends beyond the end of resilient strip 12. This is also shown in FIG. 3 by the indication in phantom of the extension of mounting member 10 and resilient strip 12 under end cap 30. End cap 30 fits flush up against the surface of table 14 which is being protected.

Cap 30 has a shell 32 which is generally divided into two cavity portions. The first cavity portion is shown in cross section in FIG. 4 and is substantially adjacent to the end of resilient strip 12. The volume of this first cavity portion is defined by the side walls 34 of the shell and the clamping wall 35, made up generally of stepped sections 38 and 42 and recess 36. The side walls are spaced apart so as to receive the full width of the resilient strip 12. The clamping wall section 38 is also sized to receive the resilient strip 12 and has a recess 36 to accommodate clip 40. Clamping wall section 38 of shell 32 engages the top of resilient strip 12.

A second cavity portion within shell 32 is defined by its side walls and clamping wall section 42. This cavity portion is characterized by a smaller vertical dimension than that established by clamping wall section 38. A portion of clip 40 is adjacent that portion of the mounting member 10 which extends beyond the end of resilient strip 12. It is beneficial for the clip 40 to be securely attached to shell 30. Clip 40 is secured in a recession 44 of the shell 30 and may also be secured by molding in place, adhesive, or any other suitable and well-known securing means. Clip 40 has gripping teeth 46 at the end distant from the end which is secured in recession 44. The teeth 46 clamp down into resilient strip 12 as shell 30 is secured to table 14 by means of a screw through cavity 48.

Figure 6:
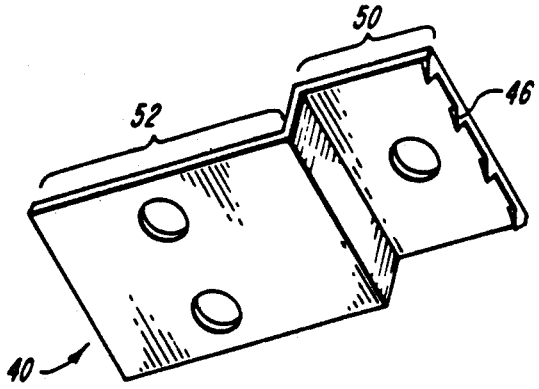
FIG. 6 is a perspective view of the rigid clip of the claimed invention.

Turning now to FIG. 6, the rigid clip 40 is shown in isolation. Clip 40 has teeth 46 or some other gripping structures, such as grooves or a rough surface, in order to clamp resilient strip 12 and hold it against its natural tendency to shrink away from the end piece. A portion 50 of clip 40 is sized to partially surround the end of resilient strip 12. This portion 50 fits into the recess 36 in shell 30 that forms the first cavity portion, defined by clamping wall 38. Another portion 52 of clip 40 lies in a plane distinct from that in which the plane of portion 50 lies and is sized to be roughly co-extensive with the portion of mounting member 10 that extends beyond resilient strip 12. The portion of the cavity of shell 30 as defined by clamping wall section 42 is sized so that when the shell 30 is clamped down by a screw, the rigid clip 40 and mounting member 10 will be securely clamped between the screw head and the substrate 14.

Figure 7:
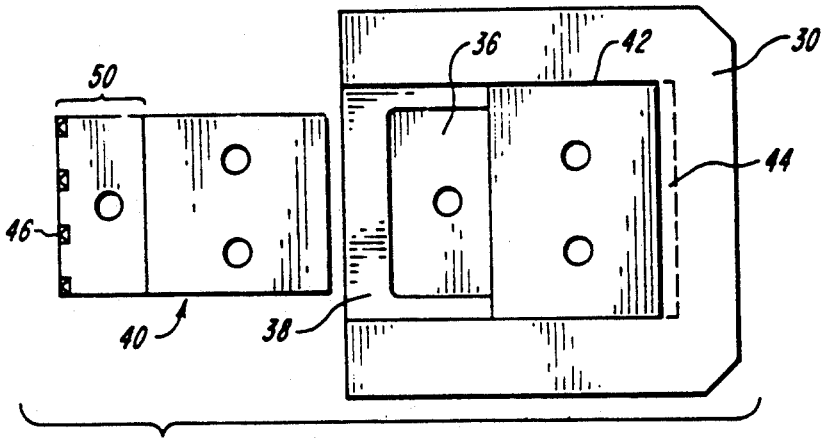
FIG. 7 is a bottom plan view of the end piece and the rigid clip of the invention with the clip displaced for clarity.

As shown in FIG. 7, the clip 40 fits into the recess 36 of clamping wall 38 and the end of the clip 40 fits into recess 44.

It will be understood that the foregoing arrangement provides for a very strong and secure means of clamping the resilient strip 12 and the mounting member 10 to the table 14. It is preferable that the rigid clip 40 be made from a rigid metal, such as steel. It is also preferable that the rigid clip be stiff so that it does not yield under the tension applied by resilient strip 12 as it tends to shrink away from the clip. Further, it is desirable that the clip 40 be stiff so that a spring force is applied downward (as shown in FIG. 5) by the teeth 46 into resilient strip 12 rather than that the clip 40 plasticly deform under the clamping pressure as the shell 30 is tightened to the substrate. Suitable material for the clip is 22 gauge cold rolled steel. As can be seen in FIG. 5, the resilient strip is partially surrounded by shell 30 over a short length, in practice about one-half to one inch. Therefore, there is no gap between the strip 12 and the end piece 30 and none of the drawbacks of the prior art arise due to the existence and growth of such a gap.

It is generally preferable that the shell 30 be made from semi-rigid vinyl, preferably 95 Shore A scale durometer. This will provide protection at the corner similar to the protection provided by the resilient strip. Further, vinyl is strong enough so that it may be anchored to the substrate by means of screws. It also will facilitate color matching as the resilient strip is also made of vinyl. It will be understood that other plastic materials will be appropriate for specific applications. These other plastics include but are not limited to acrylic, low durometer vinyl, high durometer vinyl, pvc, etc.

Figure 8:
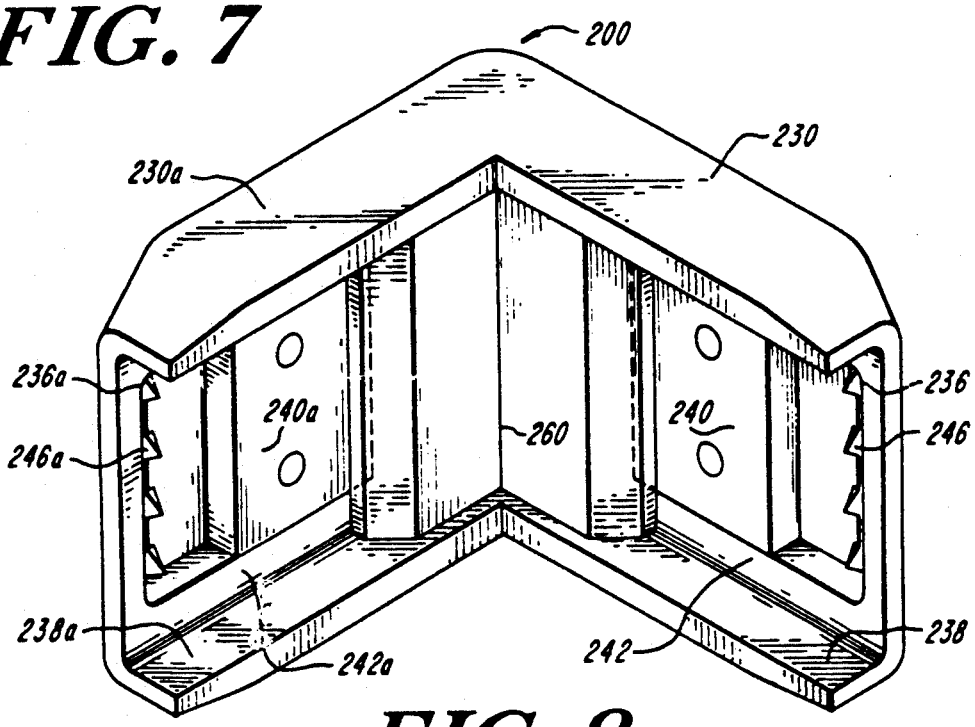
FIG. 8 is a perspective view of a corner assembly of the invention.

As has been mentioned, the present invention can be applied to a corner piece as well as an end piece. As shown in FIG. 8, a corner piece 200 embodies the present invention by having a pair of extensions 230 and 230*a*, which extend perpendicular from a common spine 260. Each extension is designed substantially identically to the end cap described and shown in FIGS. 3, 4, 5 and 7. Each has a section 238, 238*a*, sized to receive a mounting member and resilient strip along with a recess 236, 236*a* for the portion of rigid clip 240, 240*a* equipped with teeth 246, 246*a*. Each also has a cavity portion defined by clamping wall 242, 242*a*, sized to accommodate a mounting member 10 and also the portion of resilient clip 240, 240*a* pierced by holes for anchoring to the substrate 14. In all other aspects, the corner piece is used identically as would be an end piece, except that two pairs of screws are used to attach it to the substrate and it must be installed in connection with two mounting member and resilient strip assemblies.

It will be understood that when the embodiment of the invention that includes the corner piece is used, a very robust system is created including the corner and a mounting member and resilient strip for each face that the corner is adjacent. This integrated unit is much stronger than any similar unit of the prior art.

It will be understood that the foregoing invention is not limited to the geometry disclosed in the figures. For instance, it is also applicable for use with a resilient strip having a semi-cylindrical cross-section. In that case, it would simply be necessary to adapt the shape of the shell to enclose the semicylindrical resilient strip. It would also be necessary to adapt the shape of the resilient clip 40 to adequately contact the resilient strip. This rigid clip could be made by simple stamping processes well known to those skilled in the art. Any other regular shapes could also be accommodated simply by altering the shapes of the cavities of the shell 30 and the rigid clip 40.

The foregoing discussion should be illustrative and not limiting in any sense. For instance, it is not necessary that the corner pieces be made of vinyl. They may be made of harder plastic, or of any other suitable and resilient material. It is also not necessary that the rigid clip be made of metal. Certain plastics may be acceptable. It is only necessary that it be rigid enough to retain the resilient strip 12 as it tends to shrink away. The corner piece can also be used with other embodiments of mounting members and resilient strips. There may be variations in the configuration of both and the means by which the resilient strip is anchored to the mounting member. It is only necessary that the resilient strip partially surround the mounting member.

Having described the invention, what is claimed is:

1. An end piece for use with a flush fitting strip bumper for protecting a substrate, the bumper having a resilient strip that partially surrounds a mounting member, said end piece comprising:

a. a shell having:

i. a clamping wall; and ii. at least two side walls opposite each other and adjoining said clamping wall;

said walls defining a first cavity portion and a second cavity portion, said second cavity portion defining a volume less than that defined by said first cavity portion; and b. a rigid clip member fixedly attached to said clamping wall, extending from said second cavity portion of said first cavity portion, terminating at said first cavity portion in means for engaging the resilient strip, said engaging means including a projection arranged to extend into, and below an upper surface of, the resilient strip.

2. The end piece of claim 1 wherein said rigid clip member is metal.

3. The end piece of claim 1 wherein the cross-section of said volume defined by said first cavity is sized to receive said resilient strip and the cross-section of said volume defined by said second cavity is sized to receive said mounting member.

4. The end piece of claim 3 wherein said means for engaging said resilient strip comprises a plurality of projections.

5. The end piece of claim 3 wherein said metal clip is made of a spring material that provides a spring force when flexed.

6. The end piece of claim 3 wherein said shell and metal clip further comprise means for clamping said shell and metal clip to said substrate.

7. The end piece of claim 6 wherein said means for clamping to said substrate comprises at least one screw hole.

8. A corner piece for use with a pair of flush fitting strip bumpers for protecting a substrate, each bumper having a resilient strip that partially surrounds a mounting member, said corner piece comprising:

a. a shell having a pair of perpendicular extensions, each extension having:

i. a clamping wall; and ii. at least two side walls opposite each other and adjoining said clamping wall;

said walls defining a first cavity portion and a second cavity portion, said second cavity portion defining a volume less than that defined by said first cavity portion; and b. each extension having a rigid clip member, each clip member fixedly attached to said respective clamping wall, extending from said second cavity portion to said first cavity portion, terminating at said first cavity portion in means for engaging the resilient strip, said engaging means including a projection arranged to extend into, and below an upper surface of, the resilient strip.

9. A protective bumper assembly comprising:

a. a rigid mounting member;

b. a flexible and elongated protective strip that is secured in and partially surrounds said mounting member;

c. an end piece engaging said strip and mounting member, having:

i. a shell having:

A. a clamping wall; and

B. at least two side walls opposite each other and adjoining said clamping wall;

said walls defining a first cavity portion and a second cavity portion, said second cavity portion defining a volume less than that defined by said first cavity portion; and ii. a rigid clip member fixedly attached to said clamping wall, extending from said second cavity portion to said first cavity portion, terminating at said first cavity portion in a means engaging said resilient strip, said engaging means projecting below an upper surface of said resilient strip.

10. The bumper assembly of claim 9, wherein the cross-section of said volume defined by said first cavity is sized to receive said resilient strip and the cross-section of said volume defined by said second cavity is sized to receive said mounting member.

* * * * *